US005544386A

United States Patent [19]

Cobb

[11] Patent Number: 5,544,386

[45] Date of Patent: Aug. 13, 1996

[54] DOOR STOPPER DEVICE

[76] Inventor: Elliott G. Cobb, P.O. Box 381, Raeford, N.C. 28376

[21] Appl. No.: 306,399

[22] Filed: Sep. 15, 1994

[51] Int. Cl.[6] ..... E05F 5/02

[52] U.S. Cl. ..... 16/82; 292/339; 292/288; 292/343; 16/DIG. 17

[58] Field of Search ..... 16/82, DIG. 17, 16/DIG. 21; 292/288, 339, 343, 258

[56] References Cited

U.S. PATENT DOCUMENTS

| | | | |
|---|---|---|---|
| 1,304,394 | 5/1919 | Shyer | 292/338 |
| 2,760,806 | 8/1956 | Woodard et al. | 292/338 |
| 4,019,765 | 4/1977 | Nichola | 292/338 |
| 4,442,427 | 4/1984 | Morton | 292/339 |
| 4,607,253 | 8/1986 | Wooten et al. | 292/339 |
| 4,676,536 | 6/1987 | Arbic et al. | 292/339 |
| 4,819,296 | 4/1989 | Wilkins | 16/82 |
| 4,883,297 | 11/1982 | Smith | 292/339 |

*Primary Examiner*—Chuck Y. Mah

[57] ABSTRACT

A door stopper device comprising a central post having an upper component and a lower component formed of a rigid material, the lower extent of the upper component being linear and of a reduced diameter and the upper extent of the lower component being linear and of an enlarged diameter to receive the lower extent of the upper component; a U-shaped fork formed in the upper extent of the upper component, the fork being positioned vertically with respect to the door to be maintained closed with the adjacent component formed at an obtuse angle with respect thereto; a vertical foot formed at the lower end of the lower component; and spring-urged locking components coupling the area of overlap between upper and lower components.

3 Claims, 4 Drawing Sheets

DOOR STOPPER DEVICE

BACKGROUND OF THE INVENTION

1. Field of the Invention

The present invention relates to a new and improved door stopper device and, more particularly, pertains to abating the undesired opening of a door.

2. Description of the Prior Art

The use of door stops, locks, and jambs of a wide variety of designs and constructions is known in the prior art. More specifically, door stops, locks, and jambs of a wide variety of designs and constructions heretofore devised and utilized for the purpose of reducing the possibility of undesired people from opening or otherwise gaining access to a person's space through a wide variety of methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of door stops, locks, and jambs of a wide variety of designs and constructions. By way of example, U.S. Pat. No. 4,563,027 discloses another security brace.

U.S. Pat. No. 4,676,536 discloses yet another door brace device.

U.S. Pat. No. 5,064,232 discloses an entry door security bar.

Lastly, U.S. Pat. No. 5,165,741 discloses another type of security door bar.

In this respect, the door stopper device according to the present invention substantially departs from the conventional concepts and designs of the prior art, and in doing so provides an apparatus primarily developed for the purpose of abating the undesired opening of a door.

Therefore, it can be appreciated that there exists a continuing need for a new and improved door stopper device which can be used for abating the undesired opening of a door. In this regard, the present invention substantially fulfills this need.

SUMMARY OF THE INVENTION

In view of the foregoing disadvantages inherent in the known types of door stops, locks, and jambs of a wide variety of designs and constructions now present in the prior art, the present invention provides a new and improved door stopper device. As such, the general purpose of the present invention, which will be described subsequently in greater detail, is to provide a new and improved door stopper device and methods which have all the advantages of the prior art and none of the disadvantages.

To attain this, the present invention essentially comprises a new and improved door stopper device comprising, in combination, a central post having an upper component and a lower component formed of steel tubing, the lower extent of the upper component being linear and of a reduced diameter and the upper extent of the lower component being linear and of an enlarged diameter to receive the lower extent of the upper component; a U-shaped fork formed in the upper extent of the upper component, the fork being positioned vertically with respect to the door to be maintained closed with the adjacent lower extent of the upper component formed at an angle of between about 140 and 160 degrees with respect thereto; a vertical foot formed at the lower end of the lower component with an elastomeric shield thereover to form a frictional surface with the ground; spring-urged locking components coupling the area of overlap between upper and lower components, the locking components including aligned apertures in the upper component and a spring-urged finger in the lower component; and a pair of side support rods formed of a rigid material and in an inverted Y-shaped configuration coupled with respect to the upper extent of the lower component, the support rods including an upper region parallel with the lower component and a lower region at an angle of between 110 and 130 degrees with respect thereto, the lower end of the lower region of the support rods angling outwardly from the vertical center line through the central post, each at an angle of between 40 and 50 degrees from the vertical, the bottom end of the support rods being vertical with a foot secured thereto, each foot being provided with an elastomeric cover to form a frictional surface with the door.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved door stopper device which has all the advantages of the prior art door stops, locks, and jambs of a wide variety of designs and constructions and none of the disadvantages.

It is another object of the present invention to provide a new and improved door stopper device which may be easily and efficiently manufactured and marketed.

It is a further object of the present invention to provide a new and improved door stopper device which is of a durable and reliable construction.

An even further object of the present invention is to provide a new and improved door stopper device which is susceptible of a low cost of manufacture with regard to both materials and labor, and which accordingly is then susceptible of low prices of sale to the consuming public, thereby making such a door stopper device economically available to the buying public.

Still yet another object of the present invention is to provide a new and improved door stopper device which provides in the apparatuses and methods of the prior art some of the advantages thereof, while simultaneously overcoming some of the disadvantages normally associated therewith.

Even still another object of the present invention is to abate the undesired opening of a door.

Lastly, it is an object of the present invention to provide a door stopper device comprising a central post having an upper component and a lower component formed of a rigid material, the lower extent of the upper component being linear and of a reduced diameter and the upper extent of the lower component being linear and of an enlarged diameter to receive the lower extent of the upper component; a U-shaped fork formed in the upper extent of the upper component, the fork being positioned vertically with respect to the door to be maintained closed with the adjacent component formed at an obtuse angle with respect thereto; a vertical foot formed at the lower end of the lower component; and spring-urged locking components coupling the area of overlap between upper and lower components.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
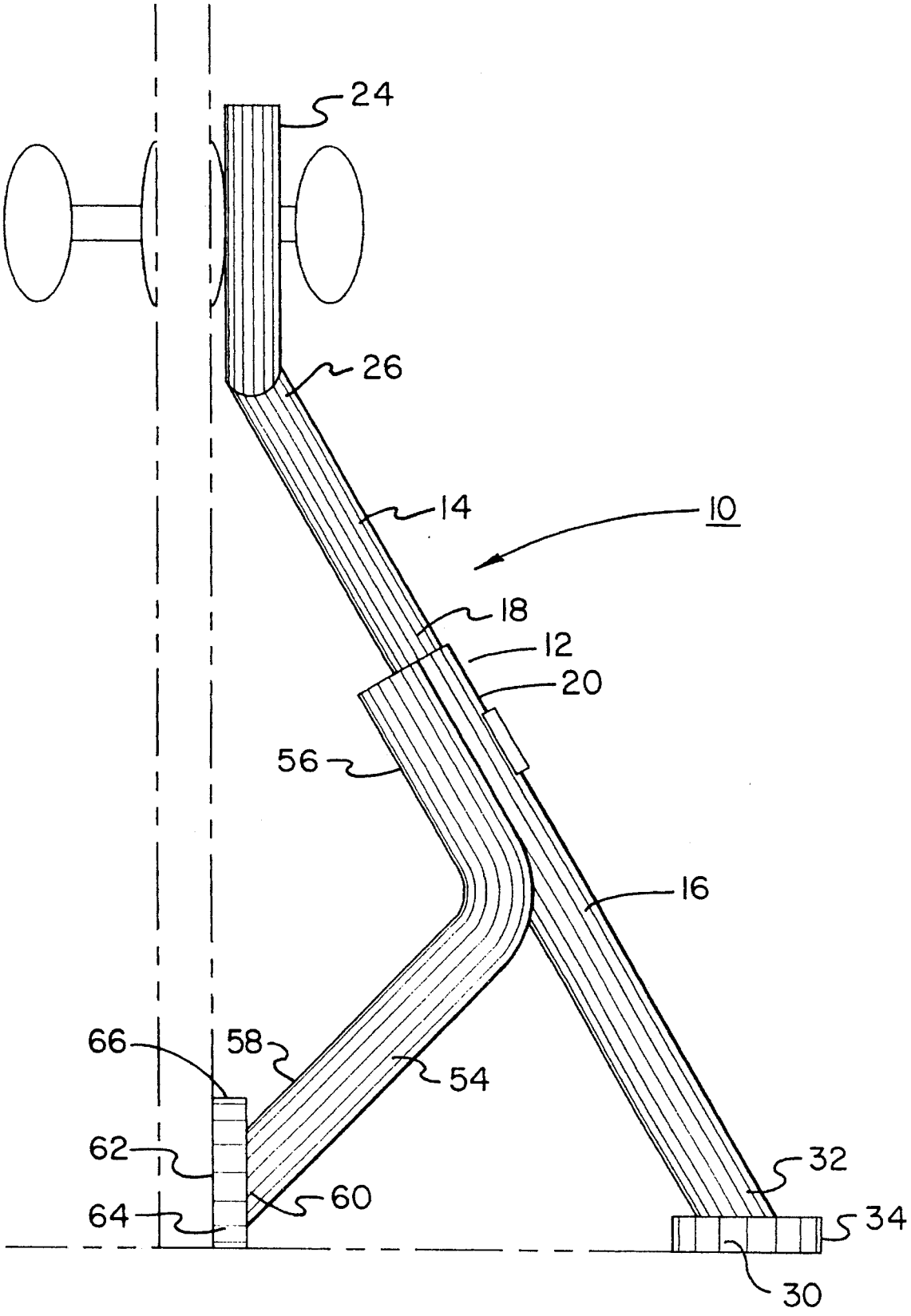
FIG. 1 is a side elevational view of the preferred embodiment of the door stopper device constructed in accordance with the principles of the present invention.
Figure 2:
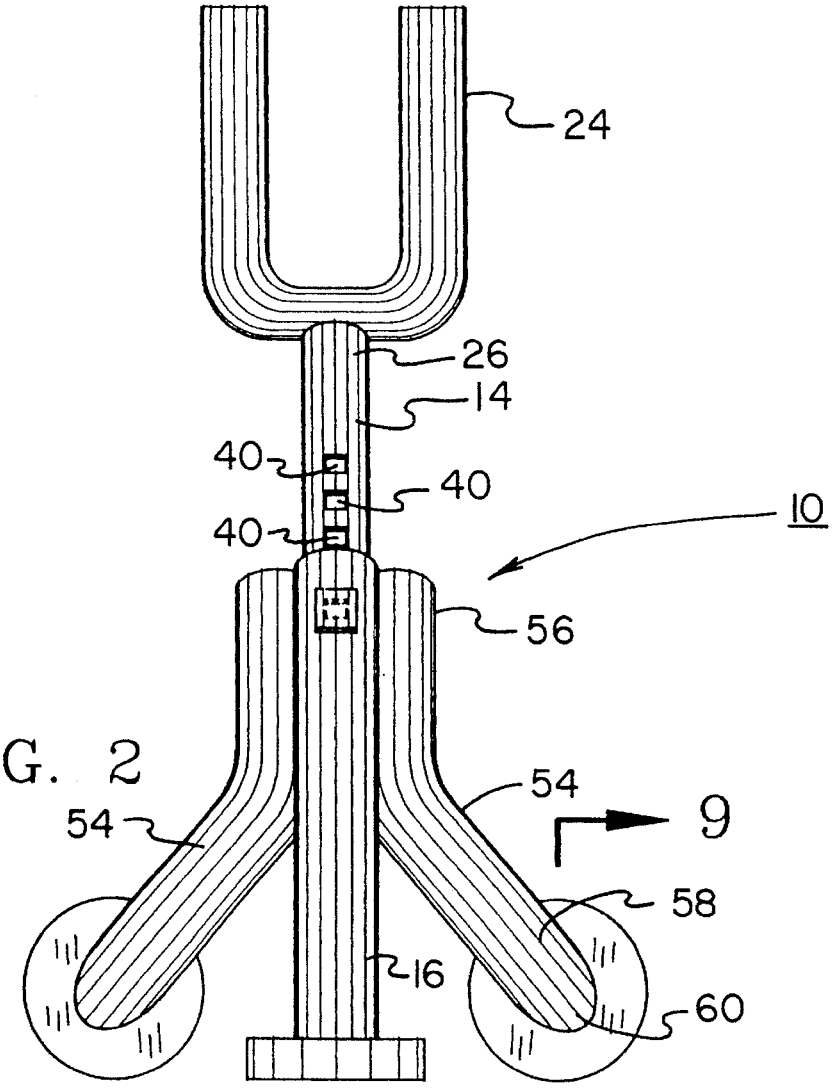
FIG. 2 is a front elevational view of the device shown in FIG. 1.
Figure 3:
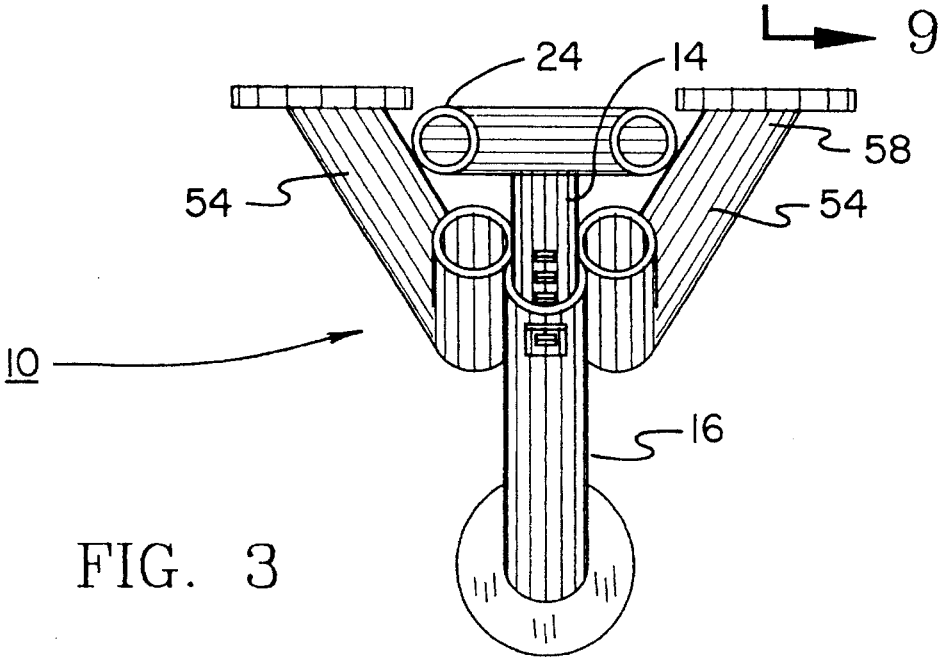
FIG. 3 is a top plan view of the device shown in FIGS. 1 and 2.
Figure 4:
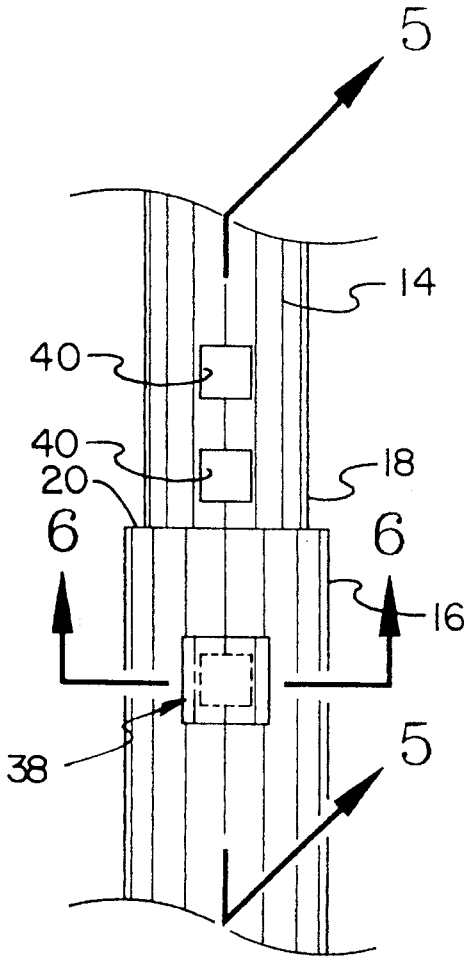
FIG. 4 is an enlarged elevational view of the adjustment components of the device shown in the prior Figure.
Figure 5:
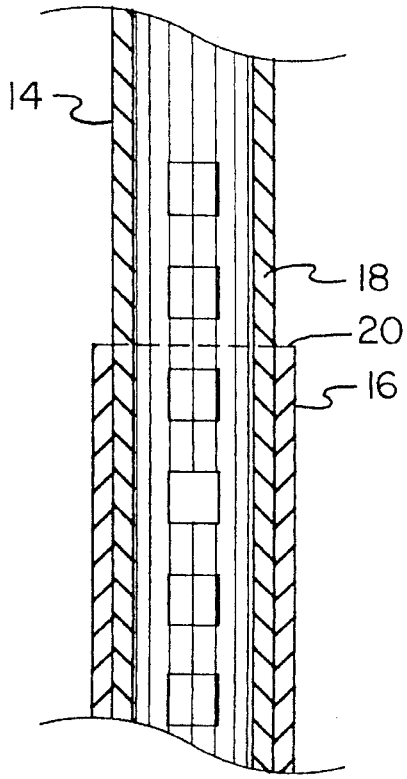
FIG. 5 is a cross-sectional view taken along line 5—5 of FIG. 4.
Figure 6:
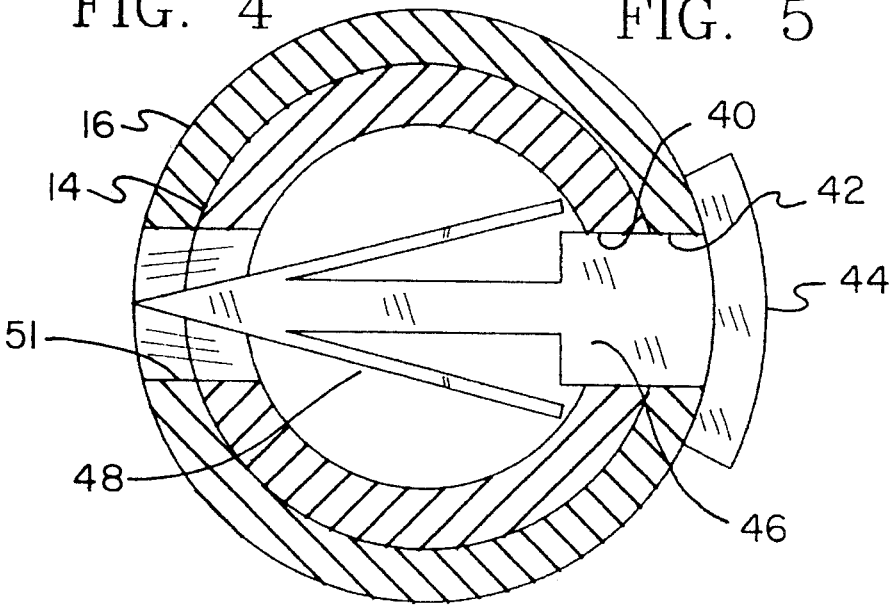
FIG. 6 is a cross-sectional view taken along line 6—6 of FIG. 4
Figure 7:
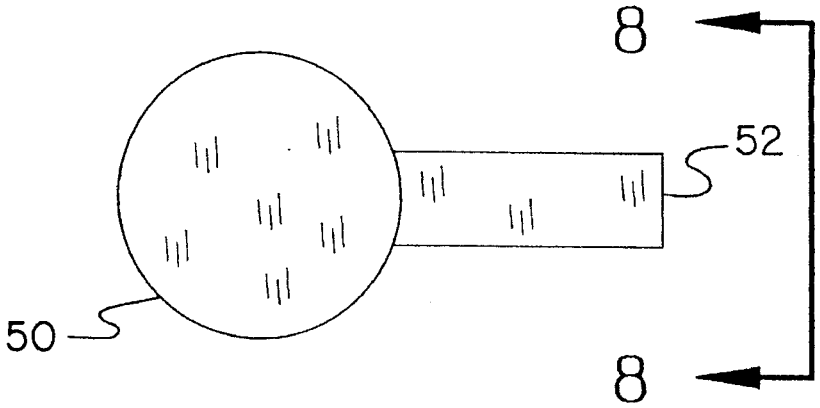
FIG. 7 is a top elevational view of a key or unlocking component of the prior Figures.
Figure 8:
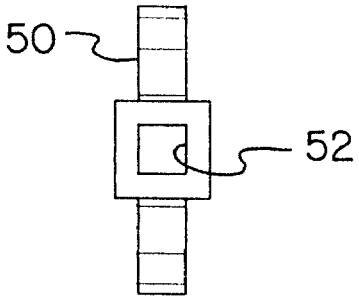
FIG. 8 is an end view of the device of FIG. 7 taken along line 8—8 of FIG. 7.
Figure 9:
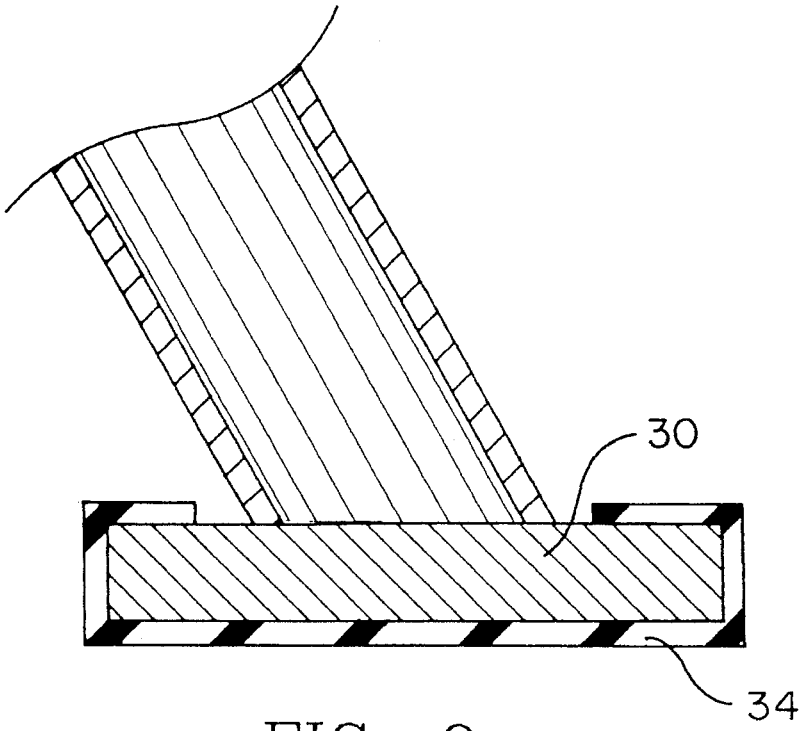
FIG. 9 is an enlarged cross-sectional view of one of the feet of the device of the prior Figures.

With reference now to the drawings, and in particular to FIG. 1 thereof, the preferred embodiment of the new and improved door stopper device embodying the principles and concepts of the present invention and generally designated by the reference numeral 10 will be described.

The present invention, the new and improved door stopper device is a system 10 comprised of a plurality of components. Such components, in their broadest context, include a central post, a U-shaped fork, a vertical foot, locking components and a pair of side supports. Each of the individual components is specifically configured and correlated one with respect to the other so as to attain the desired objectives.

The central component of the system 10 of the present invention is the central post 12. The central post has an upper component 14 and a lower component 16. Such components are separably fabricated of a steel tubing. The lower extent 18 of the upper component is linear and of a reduced diameter. The upper extent 20 of the lower component is linear and of an enlarged diameter. This allows the upper extent of the lower component to receive the lower extent of the upper component.

Next provided is a U-shaped fork 24. The fork is formed in the upper extent 26 of the upper component. The fork is positioned vertically with respect to the door which is to be maintained closed. In such orientation, the adjacent lower extent of the upper component is formed with respect thereto at an angle of preferably of about 150 degrees, preferably between about 140 and 160 degrees with respect to the adjacent component.

A horizontal foot 30 is formed at the lower end 32 of the lower component. Such foot includes an elastomeric sheild 34 thereover. This forms a frictional surface between the ground and the foot including the remainder of the central component and components thereabove.

The next components of the system are spring-urged locking components 38. Such components couple the area of overlap between the upper and lower components. The locking components include aligned apertures 40 in the upper components and a single aperture 42 in the lower component. An enlarged button 44 is located exterior of the exterior component. Interior thereof is a block 46 effecting a sure coupling between the apertures of the lower and upper components. A V-shaped member 48 with resilient wings extends to span adjacent apertures. When the key 50 is inserted into a rear hole 51 through the upper and lower components, an elongated aperture 52 spans the wings of the V-shaped member to contract them. The locking member may then be pulled out by the button 44 to allow adjusting the height between the components. The member may then be reinserted after adjustment for locking purposes.

The last component of the system is a pair of side support rods 54. Such rods are also formed of a rigid material, preferably steel. They are in an inverted Y-shaped configuration. They are coupled with respect to the upper extent of the lower component. The support rods include an upper region 56 parallel with the lower component and a lower region 58. The lower region is at an angle of between about 110 and 130 degrees, preferably 120 degrees with respect to the other region of the side support rods. The lower ends 60 of the lower region of the support rods angle outwardly from the vertical center line through the central post. Each is at an angle of between about 40 and 50 degrees, preferably 45 degrees from the vertical. The bottom end 62 of the support rods is vertical with a foot 64 secured thereto. Each foot if provided with an elastomeric cover 66. Such cover forms a frictional surface with respect to the door adapted to be held close.

Security in a person's home, whether a house or an apartment, is usually provided by locks on the doors and windows. In most cases, these just provide a minor inconvenience to anyone who really wants to get in. Spring latches are easily defeated by slipping a thin sheet of plastic or metal between the door and the door frame to retract the bolt. Chain locks are also easily defeated by pushing the door hard, as their fastenings are weak. The present invention provides additional security for a house or an apartment which overcomes the weaknesses of most other door locking mechanisms. It prevents all but the most determined persons from opening a secured door. The present invention is a simple device that is placed under the doorknob to keep the door from being opened, and is removed when the door is to be opened. When not in use, it can be taken apart and stored in a small place.

The present invention consists of two pieces of steel tubing that fit together to make an angled brace that is placed under the inside doorknob or handle of a door that is to be kept closed. A U-shaped section on the top of the upper piece fits alongside of and under the doorknob. It is angled to be vertical when the invention is in place, and is covered with rubber to prevent scratching the door or doorknob. The lower piece has a tripod on its bottom formed by two short legs that are welded to it at an angle. The bottom of the tripod has rubber feet on it that provide friction to prevent sliding along the floor. The bottom of the upper piece is reduced in diameter to fit inside the top of the lower piece. The two pieces can slide apart easily but are prevented from sliding together by a key-operated lock in the upper end of the lower piece.

In use, the lower piece is unlocked and the upper piece is slid into it as far as it will go. Then the U-shaped section is placed under the doorknob and the two pieces are slid apart until the tripod is resting firmly on the floor. Should anyone attempt to open the door, the present invention will jam, preventing the door from opening. The upper piece must be unlocked to allow the door to be opened and the invention to be removed.

The present invention is easy to use, and comes apart for storage. It provides additional security from intruders and robbers for anyone who is concerned about their safety.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved door stopper device comprising, in combination:

a central post having an upper component and a lower component formed of steel tubing, the upper and lower components each having an upper extent and a lower extent, the lower extent of the upper component being linear and of a reduced diameter and the upper extent of the lower component being linear and of an enlarged diameter to receive the lower extent of the upper component;

a U-shaped fork formed in the upper extent of the upper component, the fork being positioned vertically with respect to the door to be maintained closed, the lower extent of the upper component being formed at an angle of between about 140 and 160 degrees with respect to the fork;

a horizontal foot formed at the lower end of the lower component with an elastomeric shield thereover to form a frictional surface with the ground;

spring-urged locking components coupling the lower extent of the upper component within the upper extent of the lower component, the locking components including aligned apertures in the upper component and in the lower component, a spring-urged finger coupling the aligned apertures; and a pair of side support rods formed of a rigid material and in an inverted Y-shaped configuration coupled with respect to the upper extent of the lower component, the support rods including an upper region parallel with the lower component and a lower region at an angle between 110 and 130 degrees with respect thereto, the lower end of the lower region of the support rods angling outwardly from the central post, each at an angle of between 40 and 50 degrees from the central post, the support rods each having a bottom end formed vertically and including a foot secured thereto, each foot being provided with an elastomeric cover to form a frictional surface with the door.

2. A door stopper device compromising:

a central post having an upper component and a lower component formed of a rigid material, the upper and lower components each having an upper extent and a lower extent, the lower extent of the upper component being linear and of a reduced diameter and the upper extent of the lower component being linear and of an enlarged diameter to receive the lower extent of the upper component;

a U-shaped fork formed in the upper extent of the upper component, the fork being positioned vertically with respect to the door to be maintained closed, the upper component being formed at an obtuse angle with respect to the fork;

a horizontal foot formed at the lower end of the lower component; and spring-urged locking components coupling the lower extent of the upper component within the upper extent of the lower component the locking components including aligned apertures in the lower component and in the upper component, a spring-urged finger coupling the aligned apertures and a pair of side support rods coupled with respect to the lower component of the central post, the side support rods including an upper component parallel with the lower component of the central post and a lower component at an obtuse angle with respect thereto, the lower end of the lower component of the side support rods angling outwardly from the central post, each at an acute angle, the side support rods each having a bottom end formed vertically with a foot secured thereto.

3. The apparatus as set forth in claim 2 further including: an elastomeric cover over the feet of the side support rods.

* * * * *